US009004636B2

(12) United States Patent
Borrell Bayona et al.

(10) Patent No.: US 9,004,636 B2
(45) Date of Patent: Apr. 14, 2015

(54) FLUID DROPS PROVIDED IN PRINT MODE AND MAINTENANCE MODE IN NORMAL CONSUMPTION STATE AND LOW CONSUMPTION STATE

(75) Inventors: M. Isabel Borrell Bayona, Barcelona Manresa (ES); Sergio Puigardeu Aramendia, Barcelona (ES); Luis Garcia Garcia, Les Roquetes (ES); Angel Martinez Barambio, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 169 days.

(21) Appl. No.: 13/452,781

(22) Filed: Apr. 20, 2012

(65) Prior Publication Data

US 2013/0278659 A1 Oct. 24, 2013

(51) Int. Cl.
*B41J 29/38* (2006.01)
*B41J 2/175* (2006.01)

(52) U.S. Cl.
CPC ..... *B41J 2/175* (2013.01); *B41J 2002/17569* (2013.01)

(58) Field of Classification Search
CPC ..... B41J 29/38
See application file for complete search history.

(56) References Cited

U.S. PATENT DOCUMENTS 5,663,750 A * 9/1997 Sakuma ..... 347/7
6,174,042 B1 * 1/2001 Kobayashi et al. ..... 347/23
6,234,597 B1 * 5/2001 Suzuki et al. ..... 347/7
6,513,904 B1 2/2003 Taylor et al.
6,517,175 B2 * 2/2003 Kanaya et al. ..... 347/7
6,771,378 B2 * 8/2004 Akiyama et al. ..... 358/1.14
7,048,350 B2 5/2006 Im et al.
7,258,411 B2 * 8/2007 Anderson et al. ..... 347/14
7,278,701 B2 10/2007 Fagan et al.
7,516,699 B2 4/2009 Edwards et al.
7,738,800 B2 6/2010 Yamada
2005/0018230 A1 1/2005 Green et al.
2010/0002034 A1 * 1/2010 Lapstun et al. ..... 347/10

OTHER PUBLICATIONS

Martinez et al., "Improved ink level measurement accuracy by using closed loop color calibration to estimate drop weight," Research Disclosure, Dec. 2009, pp. 1304-1306.

* cited by examiner

*Primary Examiner* — Manish S Shah
*Assistant Examiner* — Jeremy Delozier
(74) *Attorney, Agent, or Firm* — Hewlett-Packard Patent Department

(57) ABSTRACT

An image forming apparatus includes a normal consumption state, a low consumption state, and a fluid applicator unit. The fluid applicator unit may selectively provide a first set of drops of fluid to perform a printing routine in a print mode. The fluid applicator unit may also selectively provide a second set of drops of fluid to perform a service routine in a maintenance mode. An amount of the first set of drops of fluid to perform the printing routine and an amount of the second set of drops of fluid to perform the service routine may be less in the low consumption state than in the normal consumption state.

20 Claims, 7 Drawing Sheets

FLUID DROPS PROVIDED IN PRINT MODE AND MAINTENANCE MODE IN NORMAL CONSUMPTION STATE AND LOW CONSUMPTION STATE

BACKGROUND

Image forming apparatuses may include fluid applicator units, a fluid supply and a fluid detection module. The fluid supply may provide fluid to the fluid applicator units to eject fluid such as ink in the form of drops on substrates in a print mode. The fluid applicator units may also eject fluid to maintain the fluid applicator units in a maintenance mode. The fluid detection module may detect a fluid level of the fluid supply.

BRIEF DESCRIPTION OF THE DRAWINGS

Non-limiting examples are described in the following description, read with reference to the figures attached hereto and do not limit the scope of the claims. Dimensions of components and features illustrated in the figures are chosen primarily for convenience and clarity of presentation and are not necessarily to scale. Referring to the attached figures:

DETAILED DESCRIPTION

Image forming apparatuses such as large format printing presses may include fluid applicator units, a fluid supply and a fluid detection module. The fluid supply may provide fluid to the fluid applicator units to eject fluid such as ink in the form of drops on substrates in a print mode. The fluid applicator unit may also eject fluid to maintain the fluid applicator units in a maintenance mode. The fluid detection module may detect a level of fluid of the fluid supply. However, the fluid may run out during a current print job and before it is completed. Thus, completion of the current print job may be delayed until the fluid supply is replenished and/or replaced. Consequently, timely completion of the current print job may not be accomplished.

In examples, an image forming apparatus having a normal consumption state and a low consumption state includes, amongst other things, a fluid applicator unit, a fluid supply, and a low fluid identification unit. The fluid applicator unit may selectively provide a first set of drops of fluid to perform a printing routine in a print mode. The fluid applicator unit may also selectively provide a second set of drops of fluid to perform a service routine in a maintenance mode. The fluid supply may provide fluid to the fluid applicator unit. An amount of the first set of drops of fluid to perform the printing routine and an amount of the second set of drops of fluid to perform the service routine may be less in the low consumption state than in the normal consumption state. That is, for a respective image, less fluid is consumed to perform each one of the corresponding print routine and service routine by using the low consumption state rather than the normal consumption state, while still providing acceptable image quality and not significantly adversely impacting the lifespan of the fluid applicator unit.

Additionally, in the low consumption state as compared with the normal consumption state, the ratio of the second set of drops of fluid used in the maintenance mode that is saved is greater than the ratio of the first set of drops of fluid used in the print mode that is saved in the low consumption state. Thus, even in the low consumption mode, the decrease in color saturation is minimized in order to produce acceptable image quality. The low fluid identification unit may identify a low fluid condition based on the amount of fluid detected in the fluid supply and a complete print job parameter. The complete job parameter may correspond to the amount of fluid needed to complete the current print job. Accordingly, in response to the low fluid condition, the image forming apparatus may be able to complete the current print job in the low consumption state rather than the normal consumption state. Consequently, timely completion of the current print job may be accomplished.

Figure 1:
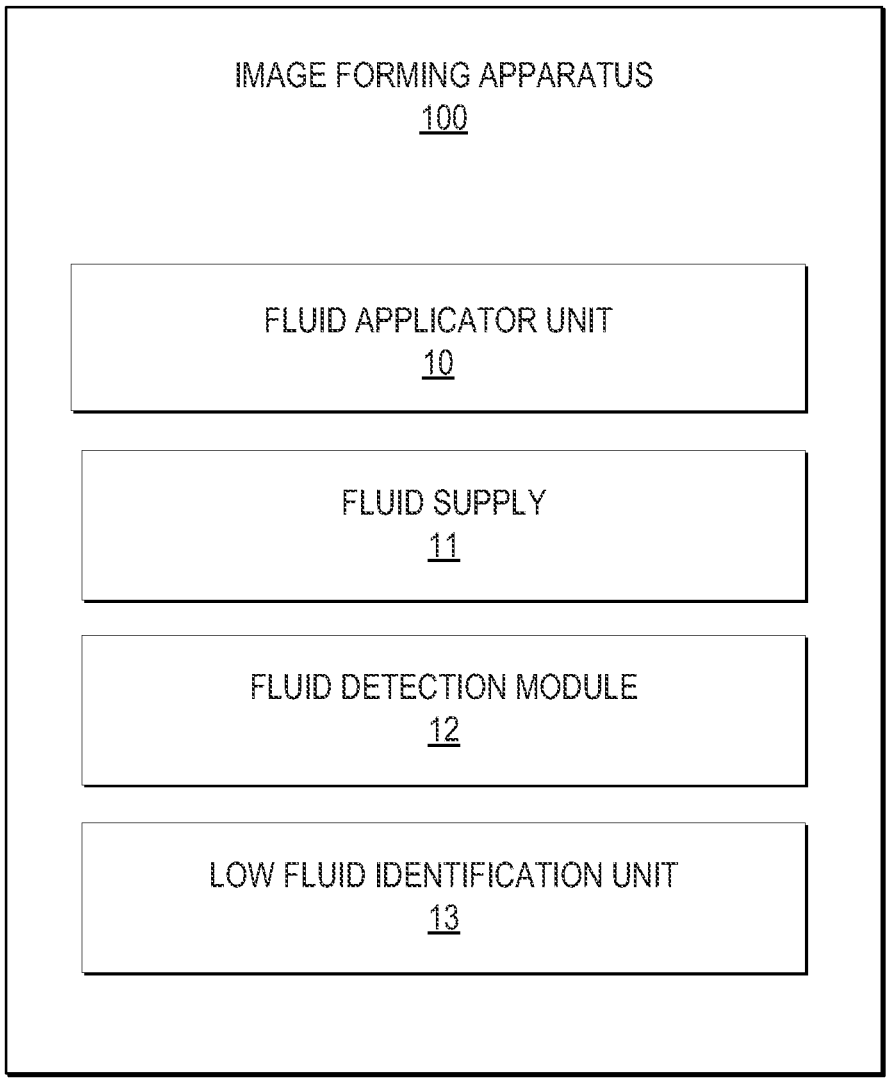
FIG. 1 is a block diagram illustrating an image forming apparatus according to an example.

FIG. 1 is block diagram of an image forming apparatus according to an example. Referring to FIG. 1, in some examples, an image forming apparatus 100 having a normal consumption state and a low consumption state includes a fluid applicator unit 10, a fluid supply 11, a fluid detection module 12, and a low fluid identification unit 13. The fluid applicator unit 10 may selectively provide a first set of drops of fluid to perform a printing routine in a print mode and a second set of drops of fluid to perform a service routine in a maintenance mode. For example, the print mode may correspond to a mode in which an image is formed on a substrate. For example, the maintenance mode may correspond to a mode in which the fluid applicator unit 10 is maintained by periodically ejecting drops of fluid to maintain, refresh and/or detect a condition of the fluid applicator unit 10. In some examples, the fluid applicator unit 10 may include an inkjet printhead having nozzles to eject fluid such as ink there through. In some examples, the fluid applicator unit 10 may include a single inkjet printhead. Alternatively, the fluid applicator unit 10 may include a plurality of inkjet printheads such that each one may correspond with a different color ink.

Referring to FIG. 1, in some examples, the fluid supply 11 may provide fluid to the fluid applicator unit 10. For example, the fluid supply 11 may include a reservoir, tank, and the like, that is disposed outside of and/or within the fluid applicator unit 10 to provide fluid thereto. The fluid detection module 12 may detect an amount of fluid in the fluid supply 11. For example, the fluid detection module 12 may determine an amount of fluid remaining in the fluid supply 11 by calculating an amount of fluid expelled from the fluid supply 11, for example, by drop counting. Alternatively, the fluid detection module 12 may include a sensor, and the like, to detect an amount of fluid remaining in the fluid supply 11. The low fluid identification unit 13 may identify a low fluid condition based on the amount of fluid detected in the fluid supply 11 and a complete print job parameter. The complete job parameter may correspond to the amount of fluid needed to complete the current print job.

An amount of the first set of drops of fluid to perform the printing routine and an amount of the second set of drops of fluid to perform the service routine may be less in the low consumption state than in the normal consumption state. That is, for a respective image, less fluid is consumed to perform each one of the corresponding print routine and service routine by using the low consumption state rather than the normal consumption state, while still providing acceptable image quality and not significantly adversely impacting the lifespan of the fluid applicator unit 100. In some examples, in the low consumption state as compared with the normal consumption state, the ratio of the second set of drops of fluid used in the maintenance mode that is saved is greater than the ratio of the first set of drops of fluid used in the print mode that is saved. Thus, even in the low consumption mode, the decrease in color saturation is minimized in order to produce acceptable image quality.

In some examples, the amount may correspond to a volume of fluid, a number of drops of fluid, and the like. In the normal consumption state, the image forming apparatus 100 may form images in the print mode and maintain the fluid applicator unit 10 in the maintenance mode at a satisfactory level. Alternatively, in the low consumption state, the image forming apparatus 100 may form images in the print mode and maintain the fluid applicator unit 10 in the maintenance mode at a satisfactory level, while consuming less fluid drops (e.g., first and second set of drops of fluid) than in the normal consumption state for an intermittent period of time.

Figure 2:
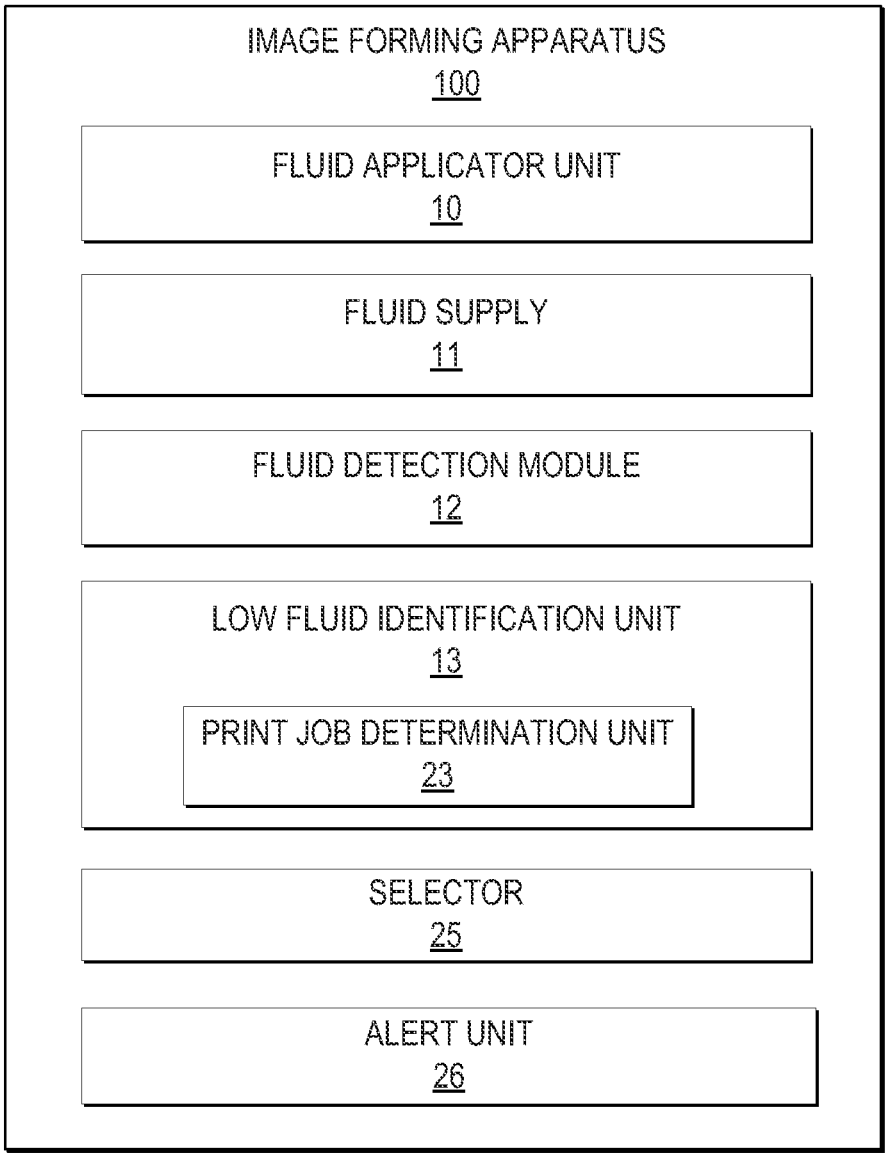
FIG. 2 is a block diagram illustrating the image forming apparatus of FIG. 1 according to an example.

FIG. 2 is a block diagram illustrating the image forming apparatus of FIG. 1 according to an example. Referring to FIG. 2, in some examples, the image forming apparatus 100 may include the fluid applicator unit 10, the fluid supply 11, the fluid detection module 12, and the low fluid identification unit 13 as previously disclosed with respect to FIG. 1. Referring to FIG. 2, the image forming apparatus 100 may also include a selector 25, an alert unit 26, and the low fluid identification unit 13 including a print job determination unit 23. The selector 25 may activate the low consumption state. For example, the selector 25 may be manually activated such as by a switch, soft key, and the like. Alternatively, the selector 25 may be automatically activated, for example, through machine-readable instructions, and the like. The alert unit 26 may alert a user in response to identification of the low fluid condition by the low fluid identification unit 13. In some examples, the alert unit 26 may provide an audio and/or visual warning.

In some examples, the complete print job parameter may be based on a predetermined value that may correspond to the substrate size of the current print job. For example, such information may be in a form of image data and obtained from a processing unit of the image forming apparatus 100. Alternatively, the complete print job parameter may be based on an amount of fluid needed to complete a current print job based on the current print job determined by the print job determination unit 23. For example, an amount of fluid needed to complete a respective print job may be computed from halftone values for each color channel and a drop weight corresponding to a respective printhead. The printing routine may also include a routine to provide the first set of drops of fluid to a substrate by the fluid applicator unit 10 to form images corresponding to image data for a respective print job. The amount of the first set of drops of fluid to perform the printing routine in the low consumption state may correspond to the amount of the first set of drops of fluid to perform the printing routine in the normal consumption state reduced by a scale factor to lower a respective contone level for a respective color of the fluid with respect to an image. Contone level may correspond to a level in a range of color densities from 0 to 255. These 256 levels may be used to depict an eight bit digital image. In some examples, the scale factor may be in a range from seventy percent to ninety percent.

In some examples, the fluid detection module 12, low fluid identification unit 13 and/or print job determination unit 23 may be implemented in hardware, software including firmware, or combinations thereof. The firmware, for example, may be stored in memory and executed by a suitable instruction-execution system. If implemented in hardware, as in an alternative example, the fluid detection module 12, low fluid identification unit 13 and/or print job determination unit 23 may be implemented with any or a combination of technologies which are well known in the art (for example, discrete-logic circuits, application-specific integrated circuits (ASICs), programmable-gate arrays (PGAs), field-programmable gate arrays (FPGAs), and/or other later developed technologies. In other examples, the fluid detection module 12, low fluid identification unit 13 and/or print job determination unit 23 may be implemented in a combination of software and data executed and stored under the control of a computing device.

Figure 3:
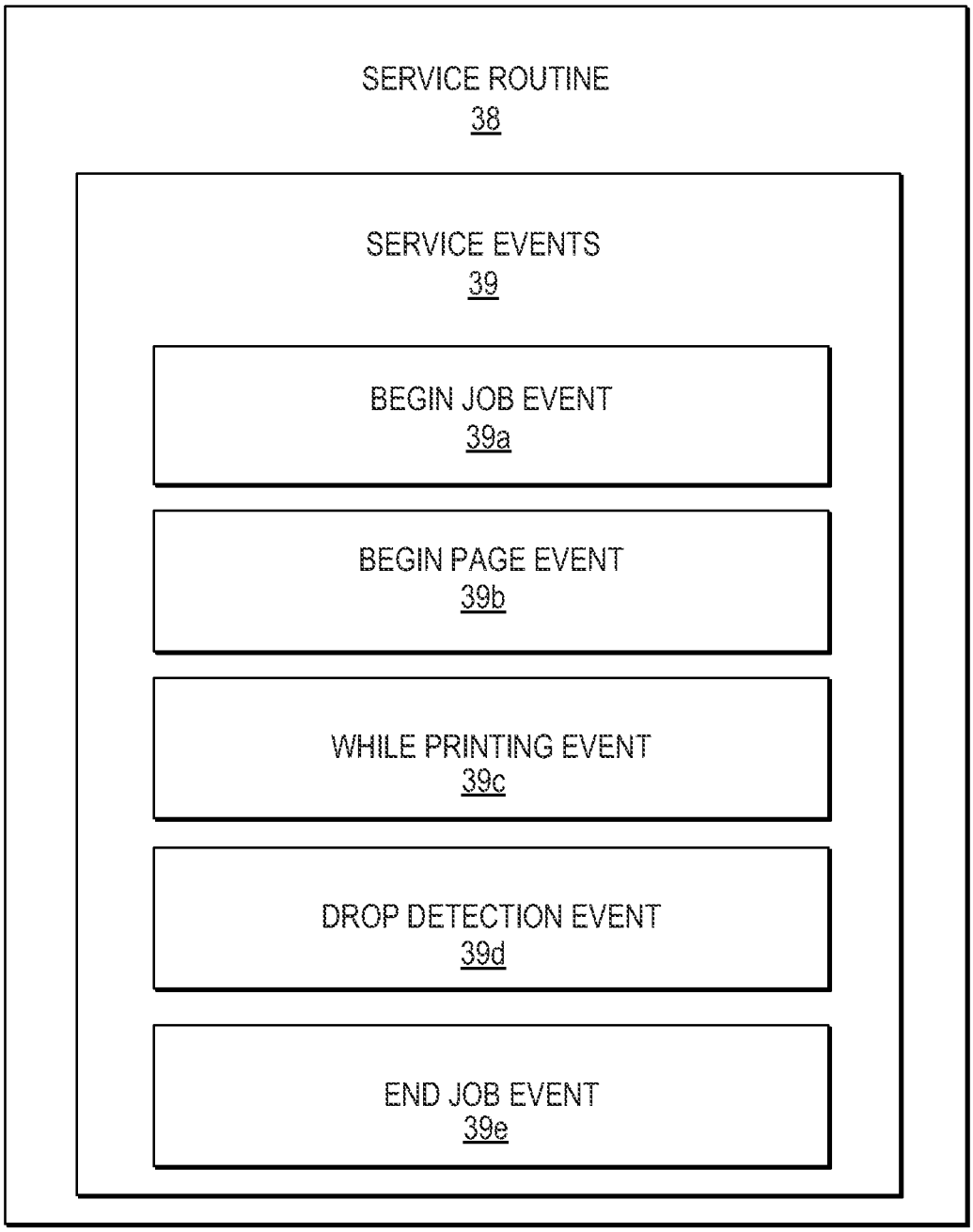
FIG. 3 is a block diagram illustrating a service routine including a plurality of service events of the image forming apparatus of FIG. 1 according to an example.

FIG. 3 is a block diagram illustrating a service routine including a plurality of service events of the image forming apparatus of FIG. 1 according to an example. Referring to FIG. 3, in some examples, the service routine 38 may also include a plurality of service events 39 including a begin job event 39*a*, a begin page event 39*b*, a while printing event 39*c*, a drop detection event 39*d*, and/or an end job event 39*e*. For example, the service routine 38 may also include a plurality of service events 39 including at least one of the begin job event 39*a* during which drops of the second set of drops of fluid are ejected from the fluid applicator unit 10 at a beginning of each print job and a begin page event 39*b* during which drops of the second set of drops of fluid are ejected from the fluid applicator unit 10 for each page in the respective print job. The service routine 38 may also include the while printing event 39*c* during which drops of the second set of drops of fluid are ejected from the fluid applicator unit 10 at an end of each swath in the respective print job. The service routine 38 may also include the drop detection event 39*d* during which drops of the second set of drops of fluid are ejected from the fluid applicator unit 10 and, for example, detected by a drop detector. The service routine 38 may also include the end job event 39*e* during which drops of the second set of drops of fluid are ejected from the fluid applicator unit 10 at an end of the respective print job.

In some examples, the plurality of service events 39 may include each one of the begin job event 39*a*, the begin page event 39*b*, the while printing event 39*c*, the drop detection event 39*d*, and the end job event 39*e*. For example, the begin job event 39*a* may occur to wake up the fluid applicator unit 10 when it has been idle for a certain period of time. This respective event may be initiated in response to the image forming apparatus 100 receiving a new print job. The begin page event 39*b* may occur when a print job contains more than one page. For example, the fluid applicator unit 10 may be in an idle state while the image forming apparatus 100 loads a new substrate. Thus, the fluid applicator unit 10 may have to be maintained before the new page is printed. In the begin page event 39*b*, the amount of fluid ejected may be much lower than in the begin job event 39*a* because the short idle time when loading a new substrate is generally not long enough to let the fluid completely dry on a surface of the fluid applicator unit 10.

The while printing event 39*c* may occur at an end of each swath. As the fluid applicator unit 10 may remain idle a short period of time until a subsequent swath is printed, the fluid applicator unit 10 may have to be maintained to avoid potential image quality issues. The drop detection event 39*d* may periodically occur to perform drop detection. The drop detection may be initiated to detect and replace clogged nozzles to avoid potential image quality issues. The end job event 39*e* may occur at an end of a print job. When a print job is completed, some drops may be ejected to enable the fluid applicator unit 10 to be capped in optimal working conditions. For each one of the plurality of service events 39, an amount of respective drops provided by the fluid applicator unit 10 may be less in the low consumption state than the normal consumption state.

Table 1 represents an example of a reduction of an amount of fluid used by an image forming apparatus 100 in a service routine in the low consumption state as compared to the normal consumption state. As illustrated in Table 1, the image forming apparatus 100 uses 1000 drops of fluid for the service routine in the normal consumption state, but only uses 600 drops of fluid for the service routine in the low consumption state. Accordingly, the amount of fluid saved performing the service routine in the low consumption state, rather than the normal consumption state, may be about forty percent. In some examples, each one of the service events consumes a less amount of drops in the low consumption state than in the normal consumption state as illustrated in Table 1. In this example, drops of fluid in begin job event 39*a* and the end job event 39*e* are reduced to a less extent than in the other service events as the begin job event 39*a* and the end job event 39*e* allow adequate lifespan of the fluid applicator unit 10. Generally, the amount of fluid reduction for the service routine in the low consumption state generally does not have negative effects on the lifespan of the fluid applicator unit 100 as it is applied intermittently and during short periods of time.

TABLE 1

| | NORMAL CONSUMPTION STATE | LOW CONSUMPTION STATE |
|---|---|---|
| SERVICE EVENTS | NO. DROPS | NO. DROPS |
| BEGIN JOB EVENT | 400 | 290 |
| BEGIN PAGE EVENT | 100 | 45 |
| WHILE PRINTING EVENT | 200 | 70 |
| DROP DETECTION EVENT | 100 | 45 |
| END JOB EVENT | 200 | 150 |
| TOTAL | 1000 | 600 |

Figure 4A:
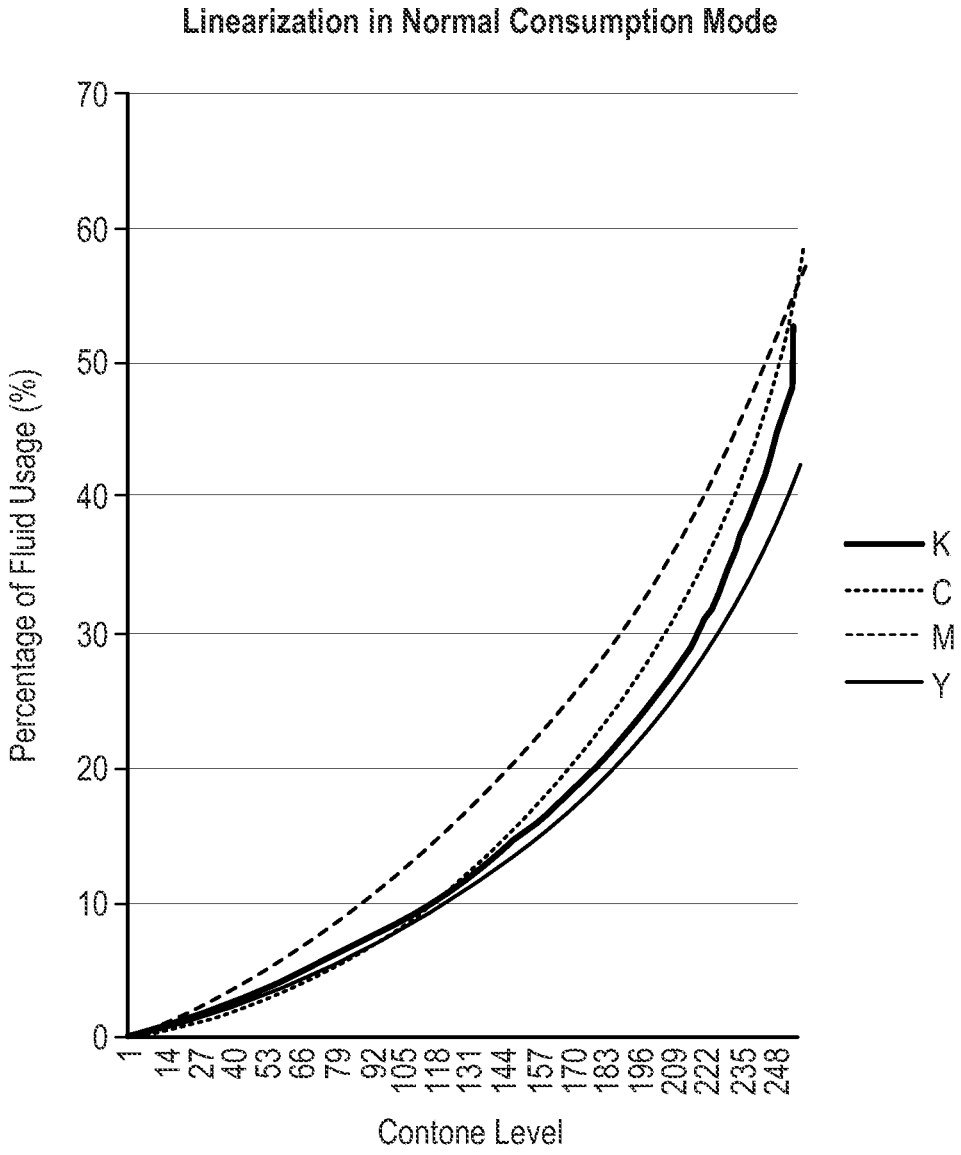
FIG. 4A is a linearization graph illustrating a relationship between contone levels of each color and an amount of fluid provided of the corresponding color for an image by the image forming apparatus of FIG. 1 in a normal consumption state according to an example.
Figure 4B:
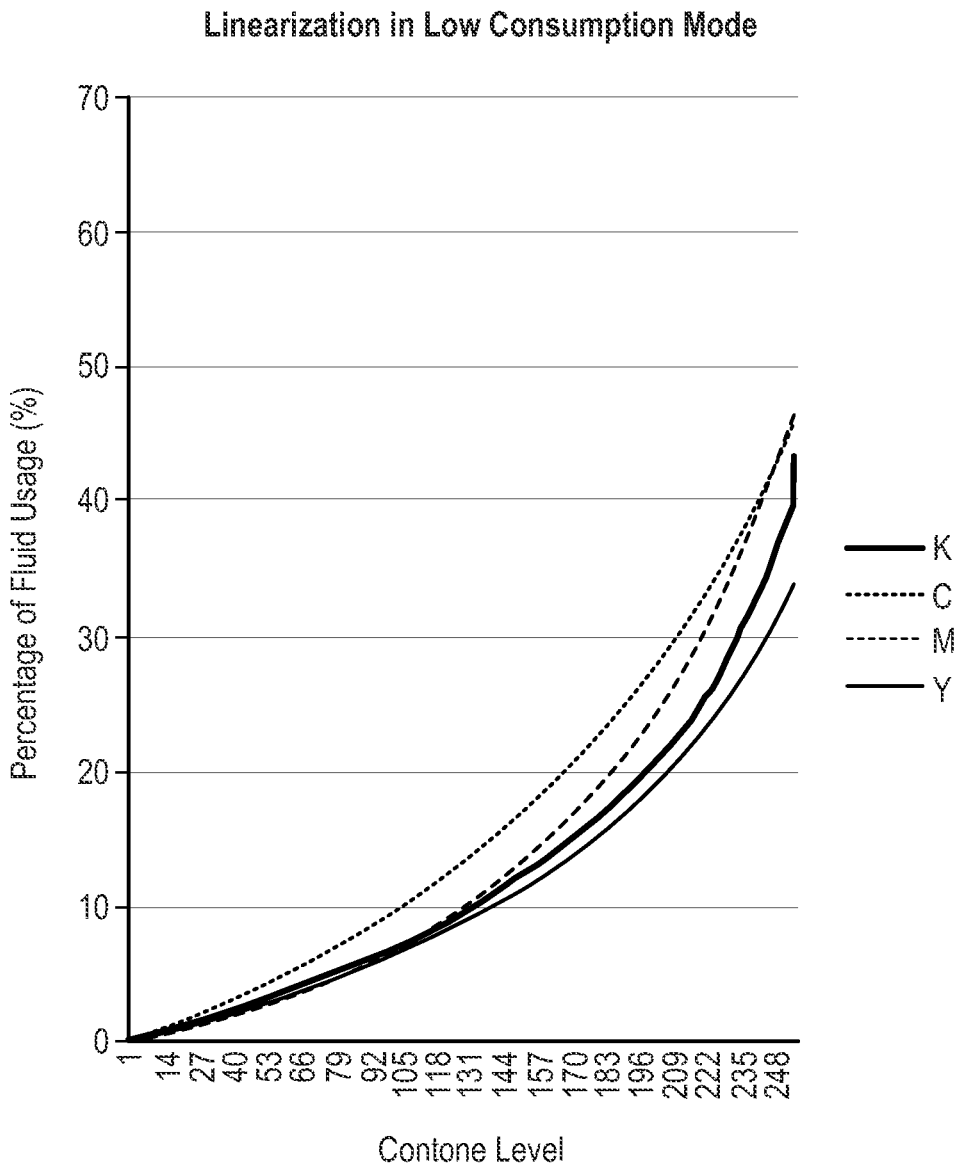
FIG. 4B is a linearization graph illustrating a relationship between contone levels of each color and an amount of fluid provided of the corresponding color for the respective image by the image forming apparatus of FIG. 1 in a low consumption state according to an example.

FIGS. 4A and 4B are linearization graphs illustrating a relationship between contone levels of each color and an amount of fluid provided of the corresponding color for a respective image by the image forming apparatus of FIG. 1 in a normal consumption state and a low consumption state, respectively, according to examples. Referring to FIGS. 4A and 4B, a plot of each representative color of fluid such as cyan, magenta, yellow, and black is depicting relating a respective contone level (e.g., contone level) to an amount of fluid used (e.g., percentage of fluid usage) of the corresponding fluid with respect to an image. For example, in some examples, the contone levels of the respective image may range from 0 to 255 and increase in value with an increase in the respective color density. The percentage of fluid usage corresponds to a total amount of fluid a fluid applicator unit 10 can eject for a given type of mode. For example, in a normal consumption state, about sixty percent of fluid usage of cyan and magenta may be used in a print mode to form an image on a substrate. Such a percentage of fluid usage may provide an optimal optical density, whereas a higher percentage may not substantially improve optical density and may result in excessive substrate deformation.

As illustrated in FIGS. 4A and 4B, in this example, a scale factor of eighty percent is applied to the linearization plots in the normal consumption state to arrive at the linearization plots in the low consumption state. Consequently, in this example, the low consumption state achieves around a twenty percent savings of an amount of fluid used in forming images on substrates in the print mode as compared to the normal consumption state. In some examples, the scale factor may be in a range from seventy percent to ninety percent. Referring to FIG. 4B, for example, the percentage of fluid usage of cyan and magenta is around fifty percent in the low consumption state instead of around sixty percent in the normal consumption state of the respective linearization plots for a respective image. Additionally, a resulting reduction in fluid density may not be substantial in terms of optical density as most users will not perceive a significant decrease in image quality. Accordingly, the low consumption state results in a reduction in the amount of fluid provided onto a substrate in the print mode and also the amount of fluid provided to maintain the fluid applicator unit 10 in the maintenance state. That is, a total consumption corresponding to a respective print job may equal the amount of the first set of drops of fluid to perform the printing routine and the amount of the second set of drops of fluid to perform the service routine corresponding to the respective print job. Additionally, the total consumption may be less in the low consumption state than in the normal consumption state by an amount in a range from twenty percent to forty percent.

Figure 5:
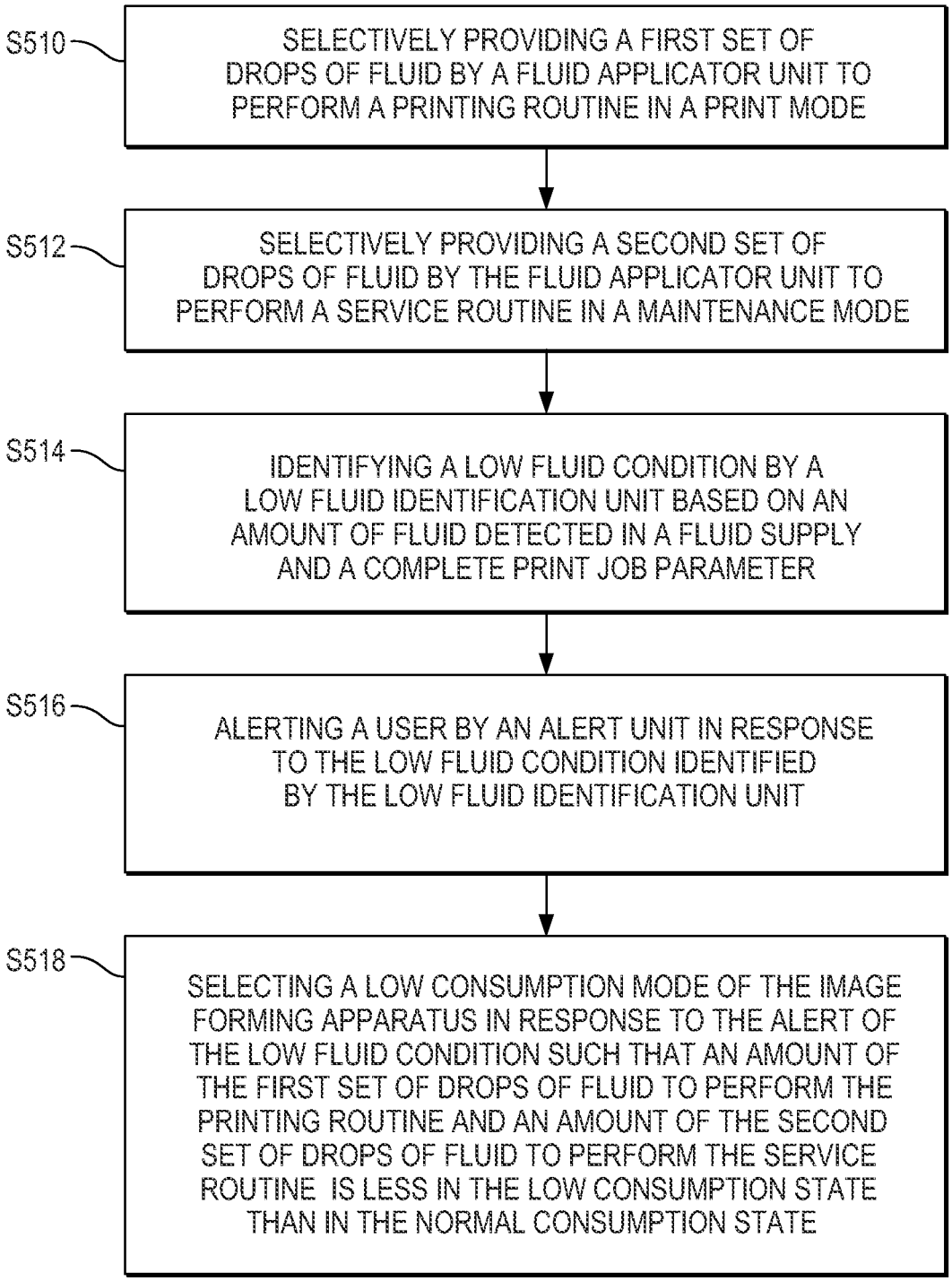
FIG. 5 is a flowchart illustrating a method of operating the image forming apparatus of FIG. 1 having a normal consumption state and a low consumption state of FIG. 1 according to an example.

FIG. 5 is a flowchart illustrating a method of operating an image forming apparatus having a normal consumption state and a low consumption state according to an example. Referring to FIG. 5, in block S510, a first set of drops of fluid is selectively provided by a fluid applicator unit to perform a printing routine in a print mode. In some examples, the selectively providing a first set of drops of fluid by a fluid applicator unit to perform a printing routine in a print mode may also include providing the first set of drops of fluid to a substrate by the fluid applicator unit to form images corresponding to image data for a respective print job. For example, the amount of the first set of drops of fluid to perform the printing routine in the low consumption state may correspond to the amount of the first set of drops of fluid to perform the printing routine in the normal consumption state reduced by a scale factor to lower a respective contone level for a respective color of the fluid.

In block S512, a second set of drops of fluid is selectively provided by the fluid applicator unit to perform a service routine in a maintenance mode. In some examples, the selectively providing a second set of drops of fluid by the fluid applicator unit to perform a service routine in a maintenance mode may further include at least one of ejecting drops of the second set of drops of fluid from the fluid applicator unit during a begin job event at a beginning of each print job, ejecting drops of the second set of drops of fluid from the fluid applicator unit during the begin job event for each page in the respective print job, ejecting drops of the second set of drops of fluid from the fluid applicator unit during a while printing event to an end of each swath in the respective print job, ejecting and detecting drops of the second set of drops of fluid from the fluid applicator unit during a drop detection event, and ejecting drops of the second set of drops of fluid from the fluid applicator unit during an end job event at an end of the respective print job. In some examples, the service routine may also include a plurality of service events including the begin job event, the begin page event, the while printing event, the drop detection event, and the end job event. In some examples, for each one of the plurality of service events, an amount of respective drops provided by the fluid applicator unit may be less in the low consumption state than the normal consumption state.

In block S514, a low fluid condition is identified by a low fluid identification unit based on an amount of fluid detected in a fluid supply and a complete print job parameter. For example, the complete print job parameter may be determined by a print job determination unit corresponding to an amount of fluid needed to complete a current print job based on the current print job. In block S516, a user is alerted by an alert unit in response to the low fluid condition identified by the low fluid identification unit. In block S518, a low consumption state of the image forming apparatus is selected in response to the alert of the low fluid condition such that an amount of the first set of drops of fluid to perform the printing routine and an amount of the second set of drops of fluid to perform the service routine is less in the low consumption state than in the normal consumption state.

Figure 6:
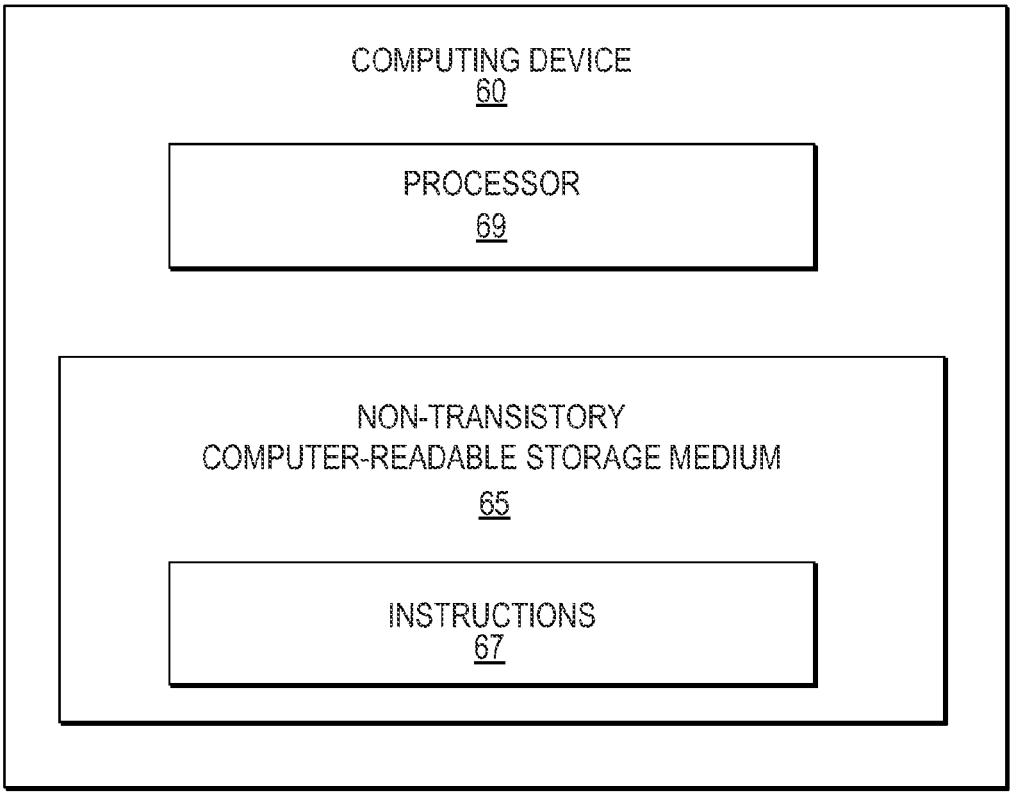
FIG. 6 is a block diagram illustrating a computing device such as an image forming apparatus including a processor and a non-transitory, computer-readable storage medium to store instructions to operate an image forming apparatus having a normal consumption state and a low consumption state according to an example.

FIG. 6 is a block diagram illustrating a computing device such as an image forming apparatus including a processor and a non-transitory, computer-readable storage medium to store instructions to operate the computing device to operate the image forming apparatus having a normal consumption state and a low consumption state according to an example. Referring to FIG. 6, in some examples, the non-transitory, computer-readable storage medium 65 may be included in a computing device 60 such as an image forming apparatus 100. In some examples, the non-transitory, computer-readable storage medium 65 may be implemented in whole or in part as instructions 67 such as computer-implemented instructions stored in the image forming apparatus 100 locally or remotely, for example, in a server or a host computing device considered herein to be part of the image forming apparatus 100.

Referring to FIG. 6, in some examples, the non-transitory, computer-readable storage medium 65 may correspond to a storage device that stores instructions 67, such as computer-implemented instructions and/or programming code, and the like. For example, the non-transitory, computer-readable storage medium 65 may include a non-volatile memory, a volatile memory, and/or a storage device. Examples of non-volatile memory include, but are not limited to, electrically erasable programmable read only memory (EEPROM) and read only memory (ROM). Examples of volatile memory include, but are not limited to, static random access memory (SRAM), and dynamic random access memory (DRAM).

Referring to FIG. 6, examples of storage devices include, but are not limited to, hard disk drives, compact disc drives, digital versatile disc drives, optical drives, and flash memory devices. In some examples, the non-transitory, computer-readable storage medium 65 may even be paper or another suitable medium upon which the instructions 67 are printed, as the instructions 67 can be electronically captured, via, for instance, optical scanning of the paper or other medium, then compiled, interpreted or otherwise processed in a single manner, if necessary, and then stored therein. A processor 69 generally retrieves and executes the instructions 67 stored in the non-transitory, computer-readable storage medium 65, for example, to operate a computing device 60 such as an image forming apparatus 100 in a normal consumption state and a low consumption state in accordance with an example. In an example, the non-transitory, computer-readable storage medium 65 can be accessed by the processor 69.

It is to be understood that the flowchart of FIG. 5 illustrates architecture, functionality, and/or operation of examples of the present disclosure. If embodied in software, each block may represent a module, segment, or portion of code that includes one or more executable instructions to implement the specified logical function(s). If embodied in hardware, each block may represent a circuit or a number of interconnected circuits to implement the specified logical function(s). Although the flowchart of FIG. 5 illustrates a specific order of execution, the order of execution may differ from that which is depicted. For example, the order of execution of two or more blocks may be scrambled relative to the order illustrated. Also, two or more blocks illustrated in succession in FIG. 5 may be executed concurrently or with partial concurrence. All such variations are within the scope of the present disclosure.

The present disclosure has been described using non-limiting detailed descriptions of examples thereof that are not intended to limit the scope of the general inventive concept. It should be understood that features and/or operations described with respect to one example may be used with other examples and that not all examples have all of the features and/or operations illustrated in a particular figure or described with respect to one of the examples. Variations of examples described will occur to persons of the art. Furthermore, the terms "comprise," "include," "have" and their conjugates, shall mean, when used in the disclosure and/or claims, "including but not necessarily limited to."

It is noted that some of the above described examples may include structure, acts or details of structures and acts that may not be essential to the general inventive concept and which are described for illustrative purposes. Structure and acts described herein are replaceable by equivalents, which perform the same function, even if the structure or acts are different, as known in the art. Therefore, the scope of the general inventive concept is limited only by the elements and limitations as used in the claims.

What is claimed is:

1. An image forming apparatus having a normal consumption state and a low consumption state, the image forming apparatus comprising:

a fluid applicator unit to selectively provide a first set of drops of fluid to perform a printing routine in a print mode and a second set of drops of fluid to perform a service routine in a maintenance mode;

a fluid supply to provide fluid to the fluid applicator unit;

a fluid detection module to detect an amount of fluid in the fluid supply; and a low fluid identification unit to identify a low fluid condition based on the amount of fluid detected in the fluid supply and a complete print job parameter;

wherein the low consumption state is selected in response to the low fluid condition, and wherein an amount of the first set of drops of fluid to perform the printing routine is less in the low consumption state than in the normal consumption state, and an amount of the second set of drops of fluid to perform the service routine is less in the low consumption state than in the normal consumption state.

2. The image forming apparatus according to claim 1, wherein, as compared to the normal consumption state, a reduction in the amount of the second set of drops of fluid to perform the service routine in the low consumption state is greater than a reduction in the amount of the first set of drops of fluid to perform the printing routine in the low consumption state.

3. The image forming apparatus according to claim 1, further comprising:

a selector to activate the low consumption state.

4. The image forming apparatus according to claim 1, further comprising:

an alert unit to alert a user in response to identification of the low fluid condition by the low fluid identification unit.

5. The image forming apparatus according to claim 1, wherein the complete print job parameter is based on a predetermined value.

6. The image forming apparatus according to claim 1, wherein the low fluid identification unit further comprises:

a print job determination unit to determine the complete print job parameter based on an amount of fluid needed to complete a current print job based on the current print job.

7. The image forming apparatus according to claim 1, wherein the service routine further comprises a plurality of service events including at least one of:

a begin job event during which drops of the second set of drops of fluid are ejected from the fluid applicator unit at a beginning of each print job;

a begin page event during which drops of the second set of drops of fluid are ejected from the fluid applicator unit for each page in the respective print job;

a while printing event during which drops of the second set of drops of fluid are ejected from the fluid applicator unit at an end of each swath in the respective print job;

a drop detection event during which drops of the second set of drops of fluid are ejected from the fluid applicator unit and detected by a drop detector; and an end job event during which drops of the second set of drops of fluid are ejected from the fluid applicator unit at an end of the respective print job.

8. The image forming apparatus according to claim 7, wherein the plurality of service events include each one of the begin job event, the begin page event, the while printing event, the drop detection event, and the end job event, wherein for each one of the plurality of service events, an amount of respective drops provided by the fluid applicator unit is less in the low consumption state than the normal consumption state.

9. The image forming apparatus according to claim 1, wherein the printing routine further comprises:

a routine to provide the first set of drops of fluid to a substrate by the fluid applicator unit to form images corresponding to image data for a respective print job.

10. The image forming apparatus according to claim 9, wherein the amount of the first set of drops of fluid to perform the printing routine in the low consumption state corresponds to the amount of the first set of drops of fluid to perform the printing routine in the normal consumption state reduced by a scale factor to lower a respective contone level for a respective color of the fluid.

11. The image forming apparatus according to claim 10, wherein the scale factor is in a range from seventy percent to ninety percent.

12. The image forming apparatus according to claim 1, wherein a total consumption corresponding to a respective print job equals the amount of the first set of drops of fluid to perform the printing routine and the amount of the second set of drops of fluid to perform the service routine corresponding to the respective print job such that the total consumption is less in the low consumption state than in the normal consumption state by an amount in a range from twenty percent to forty percent.

13. A method of operating an image forming apparatus having a normal consumption state and a low consumption state, the method comprising:

selectively providing a first set of drops of fluid by a fluid applicator unit to perform a printing routine in a print mode;

selectively providing a second set of drops of fluid by the fluid applicator unit to perform a service routine in a maintenance mode;

identifying a low fluid condition by a low fluid identification unit based on an amount of fluid detected in a fluid supply and a complete print job parameter;

alerting a user by an alert unit in response to the low fluid condition identified by the low fluid identification unit; and selecting a low consumption state of the image forming apparatus in response to the alert of the low fluid condition such that an amount of the first set of drops of fluid to perform the printing routine is less in the low consumption state than in the normal consumption state and an amount of the second set of drops of fluid to perform the service routine is less in the low consumption state than in the normal consumption state.

14. The method according to claim 13, wherein the identifying a low fluid condition by a low fluid identification unit further comprises:

determining the complete print job parameter by a print job determination unit corresponding to an amount of fluid needed to complete a current print job based on the current print job.

15. The method according to claim 13, wherein the selectively providing a second set of drops of fluid by the fluid applicator unit to perform a service routine in a maintenance mode further comprises at least one of:

ejecting drops of the second set of drops of fluid from the fluid applicator unit during a begin job event at a beginning of each print job;

ejecting drops of the second set of drops of fluid from the fluid applicator unit during the begin job event for each page in the respective print job;

ejecting drops of the second set of drops of fluid from the fluid applicator unit during a while printing event to an end of each swath in the respective print job;

ejecting and detecting drops of the second set of drops of fluid from the fluid applicator unit during a drop detection event; and ejecting drops of the second set of drops of fluid from the fluid applicator unit during an end job event at an end of the respective print job.

16. The method according to claim 15, wherein the service routine further comprises a plurality of service events including the begin job event, the begin page event, the while printing event, the drop detection event, and the end job event, wherein for each one of the plurality of service events, an amount of respective drops provided by the fluid applicator unit is less in the low consumption state than the normal consumption state.

17. The method according to claim 13, wherein, as compared to the normal consumption state, a reduction in the amount of the second set of drops of fluid to perform the service routine in the low consumption state is greater than a reduction in the amount of the first set of drops of fluid to perform the printing routine in the low consumption state.

18. The method according to claim 13, wherein the selectively providing a first set of drops of fluid by a fluid applicator unit to perform a printing routine in a print mode further comprises:

providing the first set of drops of fluid to a substrate by the fluid applicator unit to form images corresponding to image data for a respective print job.

19. The method according to claim 13, wherein the amount of the first set of drops of fluid to perform the printing routine in the low consumption state corresponds to the amount of the first set of drops of fluid to perform the printing routine in the normal consumption state reduced by a scale factor to lower a respective contone level for a respective color of the fluid.

20. A non-transitory computer-readable storage medium having computer executable instructions stored thereon for an image forming apparatus to operate in a normal consumption state and a low consumption state, the instructions are executable by a processor to:

selectively eject a first set of drops of fluid by an inkjet printhead unit to perform a printing routine in a print mode to form images on a substrate corresponding to image data;

selectively eject a second set of drops of fluid by the inkjet printhead unit to perform a service routine in a maintenance mode; and use less of an amount of the first set of drops of fluid to perform the printing routine in the low consumption state than the normal consumption, and use less of an amount of the second set of drops of fluid to perform the service routine in the low consumption state than the normal consumption state, wherein the amount of the first set of drops of fluid to perform the printing routine in the low consumption state corresponds to the amount of the first set of drops of fluid to perform the printing routine in the normal consumption state reduced by a scale factor to lower a respective contone level for a respective color of the fluid.

* * * * *

UNITED STATES PATENT AND TRADEMARK OFFICE

CERTIFICATE OF CORRECTION

PATENT NO. : 9,004,636 B2
APPLICATION NO. : 13/452781
DATED : April 14, 2015
INVENTOR(S) : M. Isabel Borrell Bayona et al.

It is certified that error appears in the above-identified patent and that said Letters Patent is hereby corrected as shown below:

In the Drawings:

In sheet 7 of 7, reference numeral 65, line 1, delete "TRANSISTORY" and insert -- TRANSITORY --, therefor.

Signed and Sealed this
Eighth Day of March, 2016

Michelle K. Lee

Michelle K. Lee
*Director of the United States Patent and Trademark Office*